US010820721B2

(12) United States Patent
Lindeman et al.

(10) Patent No.: US 10,820,721 B2
(45) Date of Patent: Nov. 3, 2020

(54) ADJUSTABLE CHILD CARRIERS

(71) Applicant: Kolcraft Enterprises, Inc., Chicago, IL (US)

(72) Inventors: Bonnie Lindeman, Yorkville, IL (US); Sarah Katharine Green, Chicago, IL (US); Shannen Root-Chin, Chicago, IL (US); Hyon Troutman, Northbrook, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 16/371,308

(22) Filed: Apr. 1, 2019

(65) Prior Publication Data

US 2019/0223619 A1 Jul. 25, 2019

Related U.S. Application Data

(63) Continuation of application No. 15/439,320, filed on Feb. 22, 2017, now Pat. No. 10,264,895.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A61G 1/00; A45F 3/04

(Continued)

(56) References Cited

U.S. PATENT DOCUMENTS 484,065 A 10/1892 Taylor
2,554,340 A 5/1951 Maxwell (Continued)

FOREIGN PATENT DOCUMENTS

AT 11620 2/2011
CA 2141121 7/1996

(Continued)

OTHER PUBLICATIONS

Baby Björn, "Baby Carrier Active," retrieved from [http://www.babybjorn.com/products/baby-carriers/baby-carrier-active/active/], on Dec. 12, 2013 (3 pages).

(Continued)

*Primary Examiner* — Brian D Nash
(74) *Attorney, Agent, or Firm* — Hanley, Flight & Zimmerman, LLC

(57) ABSTRACT

Adjustable child carriers are disclosed. A disclosed example child carrier includes a child support pouch to receive a child in a substantially upright position, where the child support pouch includes an upper pouch area, a medial pouch area and a lower pouch area. The example child carrier also includes a harness to support the child support pouch on an adult, where the harness includes a first upper strap coupled to the upper pouch area, a second upper strap coupled to the upper pouch area, and a lower strap coupled to the medial pouch area. The example child carrier also includes a first leg support coupled to the child support pouch at the lower pouch area, where the first leg support pouch has a first continuously adjustable operative surface area, and a second leg support coupled to the child support pouch at the lower pouch area, where the second leg support pouch having a second continuously adjustable surface area.

18 Claims, 10 Drawing Sheets

(58) Field of Classification Search
USPC ..... 224/160, 159
See application file for complete search history.

(56) References Cited

U.S. PATENT DOCUMENTS 2,599,474 A 6/1952 Mills
3,229,873 A 1/1966 Hershman
3,451,720 A 6/1969 Makinen
4,149,687 A 4/1979 Nunemacher
4,234,229 A 11/1980 Arnold
4,271,998 A 6/1981 Ruggiano
4,333,591 A 6/1982 Case
4,402,440 A 9/1983 Purtzer et al.
4,428,514 A 1/1984 Elf
4,434,920 A 3/1984 Moore
4,467,945 A 8/1984 Schaapveld
4,568,125 A 2/1986 Sckolnik
4,606,078 A 8/1986 Tkacsik
4,724,988 A 2/1988 Tucker
D294,429 S 3/1988 Vasquez
4,903,873 A 2/1990 Poole et al.
4,986,458 A 1/1991 Linday
4,993,612 A 2/1991 Quimby, Sr. et al.
5,011,057 A 4/1991 Perruzza et al.
5,020,709 A * 6/1991 Hoaglan ..... A47D 13/025 224/155
5,071,047 A 12/1991 Cordisco
5,178,309 A 1/1993 Bicheler et al.
5,205,450 A 4/1993 Derosier
5,205,451 A 4/1993 Manzer
5,222,641 A 6/1993 Medeiros, Jr.
5,246,152 A 9/1993 Dotseth
5,346,152 A 9/1994 Fohl
5,361,952 A 11/1994 Gold
D357,800 S 5/1995 Roan et al.
5,437,403 A 8/1995 Lemanski, II
5,490,620 A 2/1996 Berqvist
5,492,256 A 2/1996 Ive
D370,996 S 6/1996 Shimura et al.
5,522,528 A 6/1996 Petricola
5,549,356 A 8/1996 Gray
5,570,823 A 11/1996 Lindy
D377,116 S 1/1997 Shimura et al.
D378,872 S 4/1997 Shimura et al.
5,632,425 A 5/1997 Hull
D385,105 S 10/1997 Fair
5,673,836 A 10/1997 Bush
5,678,739 A 10/1997 Darling et al.
5,685,466 A 11/1997 Hsieh
5,690,258 A 11/1997 Kataoka
D388,247 S 12/1997 McLauchlan
5,692,655 A 12/1997 Fair et al.
5,732,861 A 3/1998 Jakobson
5,772,088 A 6/1998 Nelson
5,791,535 A 8/1998 Roan et al.
D397,867 S 9/1998 Fair et al.
5,813,580 A 9/1998 Fair
5,848,741 A 12/1998 Fair
D409,373 S 5/1999 Fair et al.
5,934,528 A 8/1999 Higuchi
D414,032 S 9/1999 Howell
5,950,896 A 9/1999 Theodore
6,009,839 A 1/2000 Kohn
6,023,820 A 2/2000 Fair
6,045,018 A 4/2000 Onishi
D425,696 S 5/2000 Swanke
6,073,820 A 6/2000 Drobinski
6,079,744 A 6/2000 Husby et al.
D437,996 S 2/2001 Fair et al.
6,182,873 B1 2/2001 Christopher et al.
6,257,468 B1 7/2001 Yamazoe et al.
6,325,259 B1 12/2001 Tharalson et al.
6,328,386 B1 12/2001 Good
D452,993 S 1/2002 Norman
D453,066 S 1/2002 Norman
6,343,727 B1 2/2002 Leach
D455,546 S 4/2002 Norman
6,398,088 B1 6/2002 Burke
6,409,060 B2 6/2002 Donine
6,415,969 B1 7/2002 Higuchi
6,434,750 B1 8/2002 Hunter
6,481,606 B2 11/2002 Pickett
6,520,391 B2 2/2003 Yen
6,595,396 B2 7/2003 Cummings et al.
6,598,771 B2 7/2003 Norman
6,666,361 B1 12/2003 Lin
6,672,493 B1 1/2004 Fair et al.
6,673,828 B1 1/2004 Green et al.
D488,929 S 4/2004 Nordstrom et al.
6,736,299 B2 5/2004 Bergkvist
6,763,983 B2 7/2004 Norman
6,866,174 B2 3/2005 Hiscocks
D507,102 S 7/2005 Bergkvist et al.
D507,869 S 8/2005 Liistro et al.
D509,056 S 9/2005 Shiraishi et al.
7,070,076 B2 7/2006 Bergkvist
7,168,600 B2 1/2007 Hwang
7,228,996 B2 6/2007 Keller et al.
7,252,214 B2 8/2007 Krogh
D551,442 S 9/2007 Nash
7,284,503 B2 10/2007 Elmberg
7,322,498 B2 1/2008 Frost
7,343,880 B2 3/2008 Bergkvist
D567,499 S 4/2008 Elmberg et al.
7,484,645 B2 2/2009 Hoff et al.
7,494,031 B2 2/2009 Kassai et al.
7,575,136 B2 8/2009 Kerkamp
7,661,566 B2 2/2010 Yoshie et al.
D611,698 S 3/2010 Van Der Lande
D611,699 S 3/2010 Lundh
7,766,199 B1 8/2010 Caperon
7,770,765 B2 8/2010 Stevens et al.
D623,401 S 9/2010 Bergkvist et al.
7,886,946 B2 2/2011 Gray
D642,375 S 8/2011 Zack et al.
D644,351 S 8/2011 Hasse
D649,345 S 11/2011 Bergkvist et al.
D655,494 S 3/2012 Murray et al.
D655,495 S 3/2012 Sauer et al.
8,172,116 B1 5/2012 Lehan et al.
8,272,546 B2 9/2012 Leistensnider
8,393,505 B2 3/2013 Coote
8,403,189 B2 3/2013 Nyberg et al.
8,408,435 B2 4/2013 Refsum
8,424,732 B1 4/2013 Lehan et al.
D683,384 S 5/2013 Swaggert
8,453,894 B2 6/2013 Jung et al.
8,490,844 B2 7/2013 Favorito et al.
D692,227 S 10/2013 Andren et al.
8,561,861 B2 10/2013 Muehlen
8,579,168 B2 11/2013 Zack et al.
8,584,914 B1 11/2013 Bryce
8,590,757 B2 11/2013 Frost
8,627,988 B2 1/2014 Bergkvist
8,636,181 B2 1/2014 Gunter et al.
8,701,949 B1 4/2014 Lehan et al.
8,752,739 B2 6/2014 Bergkvist et al.
8,973,794 B2 3/2015 Bergkvist et al.
9,022,260 B2 5/2015 Frost
9,185,993 B2 11/2015 Telford et al.
9,750,353 B2 9/2017 Antunovic
2003/0047573 A1 3/2003 Bergkvist
2003/0071511 A1 4/2003 Stafford et al.
2004/0016780 A1 1/2004 Cummings et al.
2004/0020951 A1 2/2004 Bergkvist
2004/0094922 A1 5/2004 Eros
2004/0094923 A1 5/2004 Eros et al.
2004/0238579 A1 12/2004 Krogh
2005/0071962 A1 4/2005 Bergkvist
2005/0077331 A1 4/2005 Keller et al.
2005/0155995 A1 7/2005 Lee
2005/0155996 A1 7/2005 Hiscocks
2005/0184114 A1 8/2005 Hoff et al.
2005/0236451 A1 10/2005 Juhlin

(56) References Cited

U.S. PATENT DOCUMENTS

| | | | | |
|---|---|---|---|---|
| 2005/0279785 | A1 | 12/2005 | Liistro et al. | |
| 2006/0000002 | A1 | 1/2006 | Bergkvist | |
| 2007/0029356 | A1 | 2/2007 | Moriguchi et al. | |
| 2008/0283559 | A1 | 11/2008 | Parness et al. | |
| 2010/0147910 | A1 | 6/2010 | Schachtner | |
| 2010/0155446 | A1 | 6/2010 | Stein et al. | |
| 2010/0308087 | A1 | 12/2010 | Lindbloom | |
| 2010/0308088 | A1 | 12/2010 | Lindblom | |
| 2011/0042429 | A1 | 2/2011 | Frost | |
| 2011/0079622 | A1 | 4/2011 | Muehlen | |
| 2011/0101051 | A1 | 5/2011 | Parness et al. | |
| 2011/0186605 | A1* | 8/2011 | Favorito | A47D 13/025 224/160 |
| 2011/0290831 | A1 | 12/2011 | Wang | |
| 2012/0043359 | A1 | 2/2012 | Bergkvist et al. | |
| 2012/0187162 | A1 | 7/2012 | Bergkvist et al. | |
| 2012/0199619 | A1 | 8/2012 | Zack | |
| 2012/0260423 | A1 | 10/2012 | Charles | |
| 2012/0286002 | A1 | 11/2012 | Dardel et al. | |
| 2012/0298702 | A1 | 11/2012 | Jung et al. | |
| 2013/0284783 | A1 | 10/2013 | Burpee | |
| 2013/0341368 | A1 | 12/2013 | Liu | |
| 2014/0014692 | A1 | 1/2014 | Andren et al. | |
| 2014/0021229 | A1 | 1/2014 | Tagle | |
| 2014/0027478 | A1 | 1/2014 | Lifshitz et al. | |
| 2014/0069968 | A1 | 3/2014 | Frost | |
| 2014/0084037 | A1 | 3/2014 | Hartwell et al. | |
| 2014/0097215 | A1 | 4/2014 | Caperon | |
| 2014/0263491 | A1 | 9/2014 | Telford et al. | |
| 2014/0319189 | A1 | 10/2014 | Hoppener-Visser | |
| 2015/0208821 | A1 | 7/2015 | Frost | |
| 2015/0374139 | A1 | 12/2015 | Salazar et al. | |
| 2016/0015187 | A1 | 1/2016 | Telford et al. | |
| 2018/0235379 | A1 | 8/2018 | Lindeman et al. | |

FOREIGN PATENT DOCUMENTS

| | | |
|---|---|---|
| EP | 0722684 | 7/1996 |
| EP | 0860127 | 8/1998 |
| EP | 2810587 | 12/2014 |
| FR | 2642946 | 8/1990 |
| FR | 2806278 | 9/2001 |
| GB | 2224635 | 5/1990 |
| KR | 20150088030 | 6/2015 |
| WO | 8404445 | 11/1984 |
| WO | 9509553 | 4/1995 |
| WO | 9716096 | 5/1997 |
| WO | 03003880 | 1/2003 |
| WO | 2004049875 | 6/2004 |
| WO | 2004049876 | 6/2004 |
| WO | 2016153411 | 9/2016 |

OTHER PUBLICATIONS

Baby Björn, "Baby Carrier One," retrieved from [http://www.babybjorn.com/products/baby-carriers/baby-carrier-one/baby . . . ], on Dec. 12, 2013 (5 pages).

Baby Björn, "Baby Carrier Original," date unknown (4 pages).

Baby Björn, "baby-carrier-active-lifefstyle-back-cotton-mis-1838-w470.jpeg", retrieved from [http://www.babybjorn.com/images/baby-carrier-active-lifefstyle-back-cotton-mix-1838-w470.pdf], on Dec. 12, 2013 (1 page).

Britax, "CarryLong System," retrieved from [http://www.britaxusa.com/learning-center/britax-baby-carrier-features/fit . . . ], on Dec. 12, 2013 (1 page).

Britax, "Removable Infant Insert," retrieved from [http://www.britaxusa.com/learning-center/britax-baby-carrier-features/fit . . . ], on Dec. 12, 2013 (2 pages).

Evenflo Company, Inc., "Snugli City Sport FBP: Front and Back Pack Soft Carrier," Aug. 2004 (12 pages).

Evenflo Company, Inc., "Snugli Classic Soft Carrier," Jun. 2003 (9 pages).

Evenflo Company, Inc., "Snugli Comfort Vent Soft Carrier," Jun. 2003 (9 pages).

Evenflo Company, Inc., "Snugli Cross Country Backpack Child Carrier," Sep. 2002 (20 pages).

Evenflo Company, Inc., "Snugli Cross Roads Backpack Child Carrier," Jun. 2003 (9 pages).

Evenflo Company, Inc., "Snugli Cross Terrain Backpack Child Carrier," Jun. 2003 (12 pages).

Evenflo Company, Inc., "Snugli Front and Back Pack Soft Carrier," Jun. 2003 (14 pages).

Evenflo Company, Inc., "Snugli Nicole Miller Soft Carrier," Oct. 2003 (9 pages).

European Patent Office, "European Search Report," issued in connection with European Application No. 18 15 8134.9, dated Jun. 19, 2018, 8 pages.

United States Patent and Trademark Office, "Non-Final Office action," issued in connection with U.S. Appl. No. 15/439,320, dated Sep. 14, 2018, 35 pages.

United States Patent and Trademark Office, "Notice of Allowance and Fee(s) Due," issued in connection with U.S. Appl. No. 15/439,320, dated Dec. 13, 2018, 10 pages.

European Patent Office, "Communication under Rule 71(3) EPC," issued in connection with European Patent Application No. 18158134.9, dated Apr. 18, 2019, 46 pages.

* cited by examiner

ADJUSTABLE CHILD CARRIERS

RELATED APPLICATION

This patent claims the benefit of U.S. patent application Ser. No. 15/439,320, filed on Feb. 22, 2017, entitled ADJUSTABLE CHILD CARRIERS, which is hereby incorporated herein by reference in its entirety.

FIELD OF THE DISCLOSURE

This disclosure relates generally to child care products and, more particularly, to adjustable child carriers.

BACKGROUND

Child carriers have been typically used by parents to carry babies (e.g., infants, newborns, etc.) while freeing their arms for other purposes and/or allowing the parents to move freely. In particular, in known examples, a carrier can be used to hold a baby or child near an abdomen and/or chest of an adult. Some known carriers allow the child to be facing towards or away from the adult while being held in a carrier.

Known child/baby carriers usually include shoulder straps coupled to a body carrying portion (e.g., a child carrying pouch), which may be composed of a fabric that surrounds at least a portion of the child. In particular, the shoulder straps are commonly used to effectively distribute the weight of the child comfortably on the adult. In many known examples, the child's legs extend out of this body carrying portion when the child is facing forward (i.e., away from the adult) or facing backwards (i.e., towards the adult).

Figure 1:
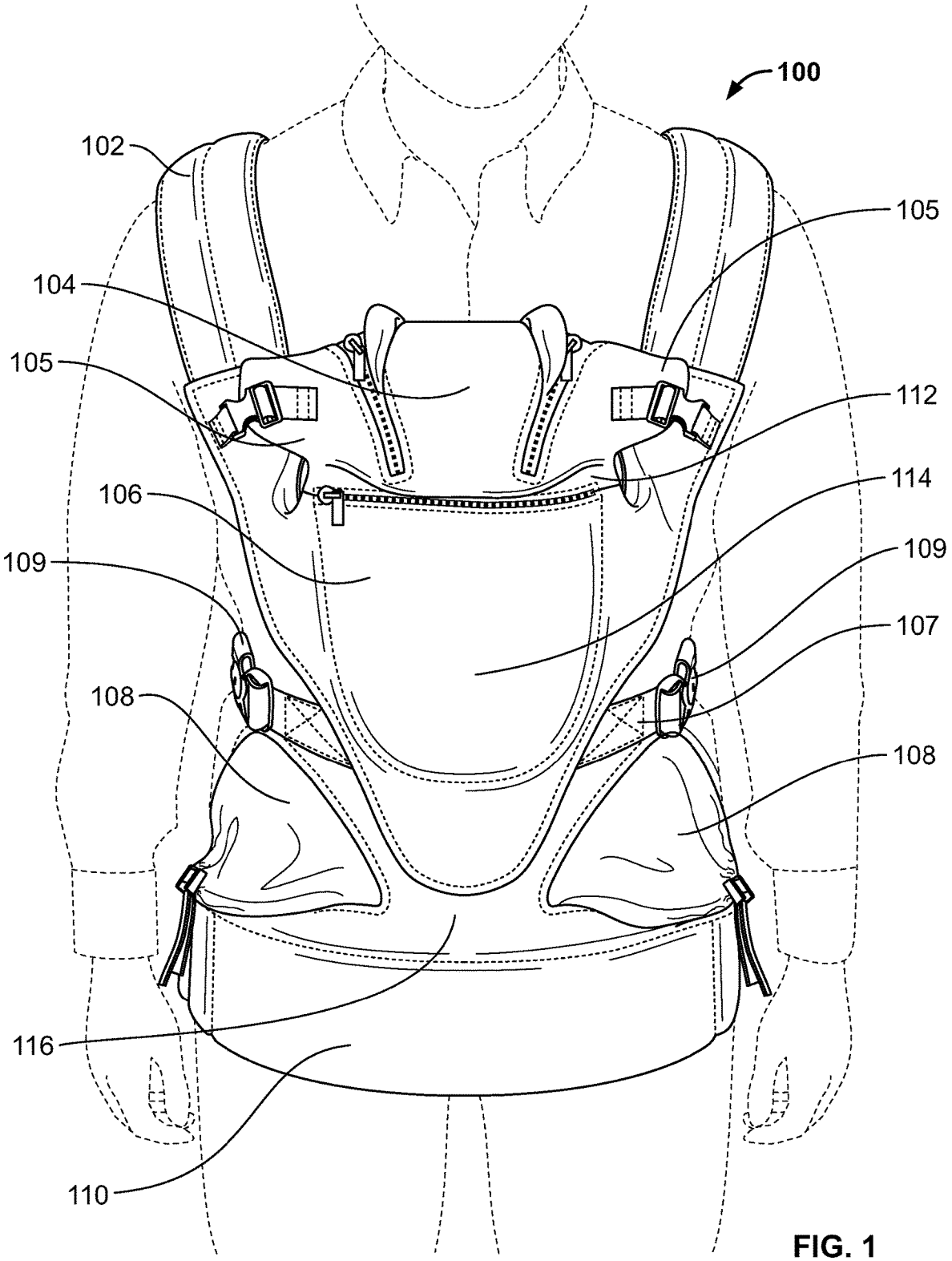
FIG. 1 illustrates a front view of an example child carrier in accordance with the teachings of this disclosure that is shown in a use position on an adult.

The figures are not to scale. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Adjustable child carriers are disclosed. Typical known carriers are used to support, restrain and/or hold a child so that an adult carrying the child has her and his hands free and, therefore, has greater freedom of movement while keeping the child within view and secure. Some known carriers have shoulder straps attached to a body carrying portion (e.g., a main portion, a carrying portion, etc.) to hold and/or support a child. In these known examples, the child is held to an abdominal/torso section of the adult and legs of the child are allowed to hang freely. Some known examples also provide a head support to support a head and/or neck of the child.

The examples disclosed herein provide highly adjustable/customizable, comfortable and cost-effective child carriers. In particular, the examples disclosed provide comfortable and ergonomic structures and/or features that provide a relatively comfortable experience to both a child and an adult (e.g., a parent, caretaker and/or guardian) carrying the child while properly securing and supporting the child in multiple positions. Some of the examples disclosed herein include an adjustable leg support (e.g., an expandable and/or foldable leg support flap) that enables legs of the child to hang or dangle freely in a first mode (e.g., a retracted or un-deployed mode) and enables at least a portion of the legs (e.g., upper legs and/or thighs of the child) to be supported in a second mode (e.g., an expanded or deployed mode). These example adjustable leg supports utilize a captive draw string and/or other length or tension adjusting device that can vary an effective surface area (e.g., a deployed surface area, an operable surface area, etc.) of the leg support to vary a degree of support provided to an upper leg or thigh of the child. The relatively low cost of components as well as ease of integration for the examples disclosed herein enable cost-effective manufacturing.

Some of the examples disclosed herein utilize an adjustable head rest in which a width (e.g., a horizontal width) is variable to adjust an amount of engagement or support of the head rest. In such examples, opening a zipper deploys or enables expansion of an expandable fabric, thereby increasing a width of the head rest.

As used herein, the term "expandable" can refer to material, a fabric and/or a component that can fold out to expand and/or stretch to expand. As a result, the deployment or expansion of a head rest or fabric (e.g., expandable fabric, stretchable fabric, foldable fabric), for example, can refer to folding out from a constrained storage or a confined boundary. As used herein, the term "body support portion" refers to a pouch or main carrying portion of a baby carrier that secures a torso and abdomen of a child. As used herein, the term "effective surface area" or "operative surface area" refers to a functional area and not necessarily to a physical surface area (e.g., an unchanged surface area) of a fabric and/or flaps, for example.

FIG. 1 illustrates an example child carrier (e.g., a baby carrier, an infant carrier, etc.) 100 in accordance with the teachings of this disclosure. The child carrier 100 of the illustrated example includes shoulder straps (e.g., upper straps) 102, an adjustable head rest 104 with head rest flaps (e.g., foldable flaps, peripheral flaps, etc.) 105, a body support portion (e.g., a child support pouch, a main body portion, a holding portion, a carrying section, etc.) 106, torso straps 107, adjustable leg support flaps 108, torso connectors 109 and a hip belt 110. In this example, the body support portion 106 includes an upper pouch area 112, a medial pouch area 114 and a lower pouch area 116.

In this example, first ends of the shoulder straps 102 are coupled to and/or integral with the upper pouch area 112 of the body support portion 106. For example, the shoulder straps 102 may be coupled to the body support portion 106 with any suitable mechanical or chemical fastener including, for example, stitching, rivets, permanent adhesive, etc. The head rest 104 of the illustrated example is coupled to and/or integrated with the upper pouch portion 112 of the body support portion 106. For example, the head rest 104 may be coupled to the body support portion 106 via any suitable mechanical or chemical fastener including those mentioned above, and, in some examples, the head rest 104 is integrally formed from the same fabric panel as one or more other portions of the body support portion 106.

According to the illustrated example, a child or baby may be held in place within the carrier 100 such that the child will contact and/or touch an adult (e.g., a parent, a caretaker, etc.) wearing the carrier 100. In this example, the child held in the illustrated carrier 100 is supported against and/or is in contact with a front side of the adult (e.g., a torso and/or an abdominal region of the adult) when being held in the body support portion 106, thereby enabling the child to feel secure by the presence of the adult.

The example carrier 100 is supported by the adult when the shoulder straps 102, which are coupled to the body support portion 106, wrap around shoulders of the adult, thereby allowing the adult to support the weight of the carrier 100 along with the child disposed in the body support portion 106 with relative ease. The example shoulder straps 102 are coupled, at a distal end (e.g., a side opposite of the side coupled to the body support portion 106), to the torso straps 107 that are coupled to the medial pouch area 114 of the body support portion 106 via respective connectors 109. In this example, the child may be positioned within the carrier 100 either facing the front side of the adult (i.e., the child is facing inward) or facing away from the front side of the adult wearing the example carrier 100 (i.e., the child is facing outward and in the same direction as the adult). Further, the hip belt 110 of the illustrated example loops around a lower portion of the torso and/or hips of the adult for increased support.

To provide a relatively comfortable fit to the child while properly restraining and/or supporting the child in a front or rear facing position, one or more portion(s) of the body support portion 106, the shoulder straps 102 and/or the hip belt 110 is composed of a breathable and elastic fabric (e.g., a perforated fabric, a mesh material, a wicking material, a 3D mesh fabric, etc.), which allows the child held in the carrier 100 to be properly cooled or ventilated for comfort. In this example, the fabric has a relatively soft feel so that the child feels comfortable when being held or carried in the example carrier 100.

To support a head and/or neck of the child, the head rest 104 is positioned in a deployed upward position. Likewise, to place the head rest 104 in an un-deployed or stowed downward position, the head rest 104 of the illustrated example can be folded downward, as discussed below. Also discussed in greater detail below in connection with FIGS. 6A and 6B, a width of the head rest 104 can be adjusted to alter a degree of engagement, support and/or contact between the head rest 104 and the child's head.

To accommodate children in different orientations and/or of different sizes, the leg support flaps 108 may be selectively deployed or retracted. In some examples, the leg support flaps 108 are adjustable to a plurality of deployment positions, which is disclosed in greater detail below in connection with FIGS. 7A, 7B, and 8A-C.

Figure 2:
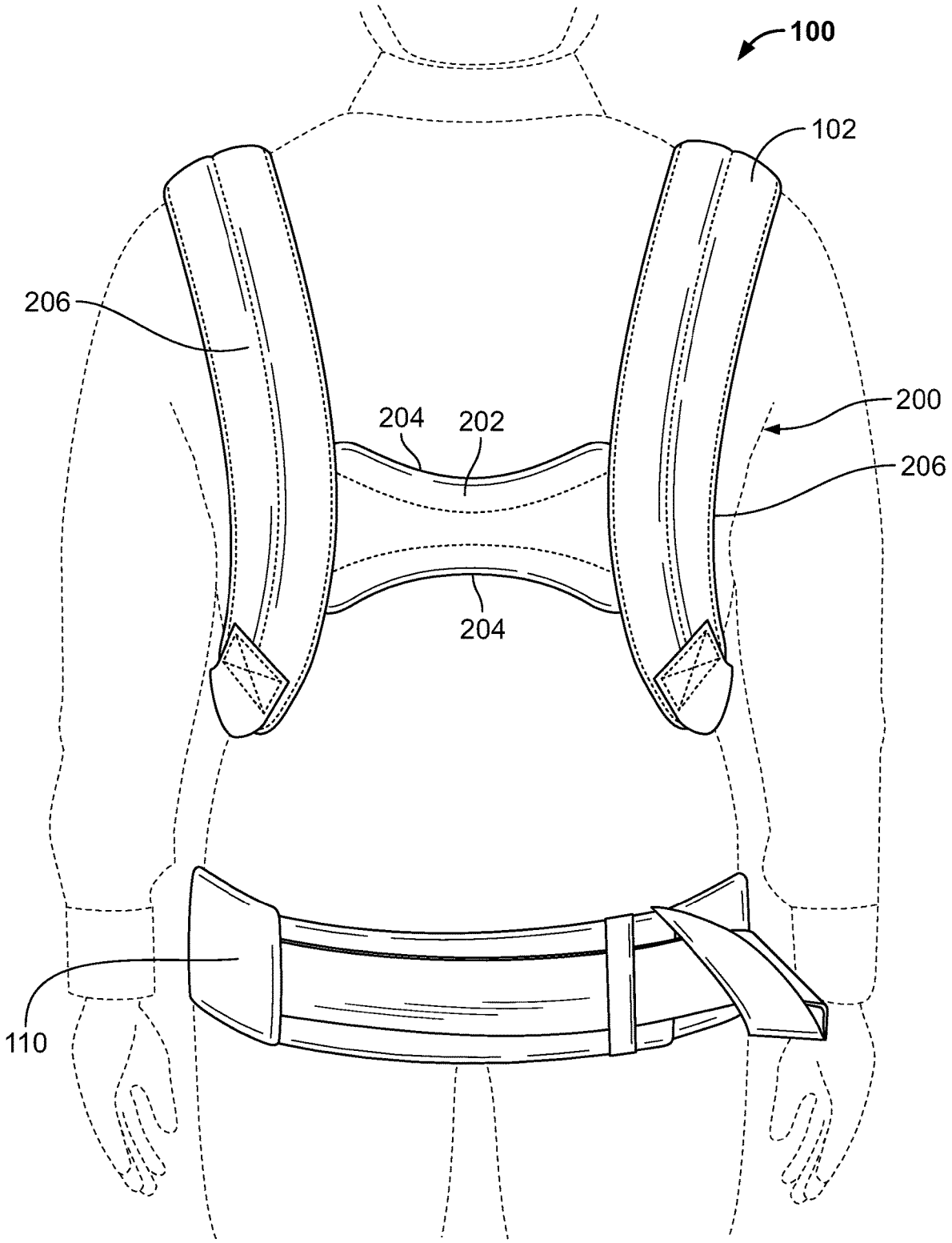
FIG. 2 illustrates a rear view of the example child carrier of FIG. 1 on the adult in the use position.

FIG. 2 illustrates a rear view of the example child carrier 100 of FIG. 1 on the adult in the use position. As shown in the example of FIG. 2, the shoulder straps 102 extend around and envelop the shoulders of the adult and at least partially define a back support 200, which includes a center support portion 202. In this example, the hip belt 110 of FIG. 1 extends around a lower back, a waist and/or hips of the adult and is not directly coupled to either the shoulder straps 102 or the center support portion 202 and, instead, is coupled to the lower pouch area 116 of the body support portion, as shown in FIG. 1.

To provide support to the back of the adult, the center support 202 of the illustrated example provides lateral support (along a horizontal distance in the view of FIG. 2) to the shoulder straps 102, thereby reducing pressure concentrations of a weight load that are acting on the adult. In this example, the center support portion 202 includes curves/contours (e.g., ergonomic contours) 204 to increase comfort of the adult as the adult carries a weight load (e.g., a distributed weight load) of a child held in the carrier 100. Further, the example shoulder straps exhibit a curvature 206 so that the shoulder straps curve around an abdomen of the adult, thereby effectively distributing the weight load across the adult's back and shoulders.

Figure 3:
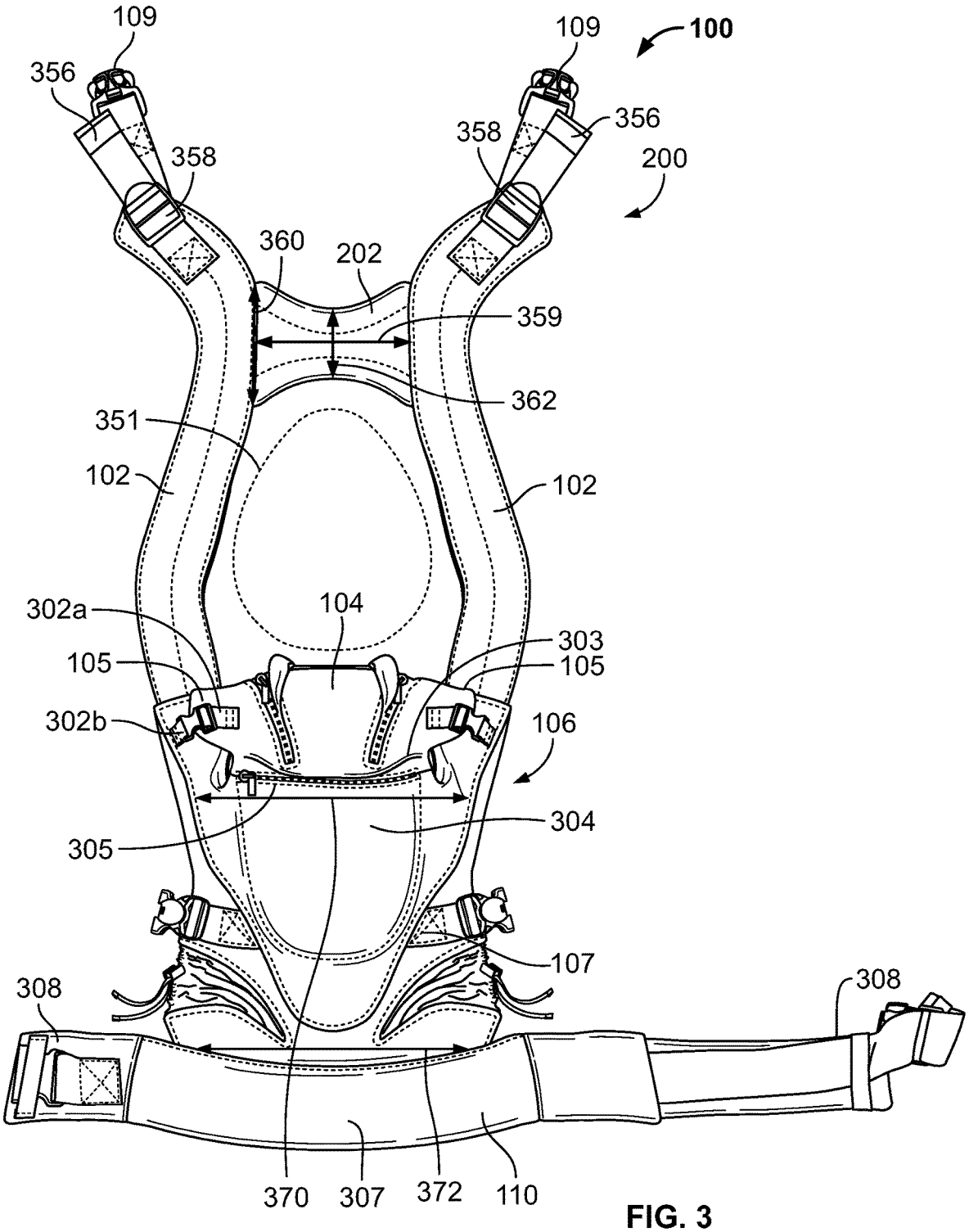
FIG. 3 is a splayed out frontal view of the example child carrier of FIG. 1 shown off of the adult.

FIG. 3 is a splayed out frontal view of the example child carrier 100 of FIG. 1 shown off of the adult. According to the illustrated view of FIG. 3, the example child carrier 100 includes a first head rest coupling portion (e.g., a connector, a release connector, a buckle, etc.) 302*a* and a complimentary second head rest coupling portion 302*b*, both of which are matably couplable to one another to support the head rest 104 in an upright position. Prior to folding the head rest 104 downward, the first head rest coupling portion 302*a* and the second head rest coupling portion 302*b* are disengaged to disengage the head rest flaps 105 from the upper portions of the body support portion 106 in the region where the shoulder straps 102 connect to the body support portion 106 so that the head rest 104 can be folded downward along a fold line 303 and away from the child's head. The head rest 104 may be placed in the folded position for relatively older children with a greater ability to support their necks and/or for children placed in the carrier 100 in an outward facing position. In some examples, the first head rest coupling portion 302*a* and the second head rest coupling portion 302*b* are countable in either the upright/support portion or the folded over position.

In this example, the body support portion 106 includes a pocket 304 with a pocket fastener 305. In this example, the pocket fastener 305 is a zipper but any other suitable mechanical fastener may be used. In some examples, the pocket 304 is used to store child caretaking related items and/or food items.

The hip belt 110 of the illustrated example includes a central hip belt portion 307 as well as outer hip belt portions 308. The central hip belt portion 307 and outer hip belt portions 308 may include padding for the comfort of the adult. The effective length(s) of the outer hip belt portions 308 may be increased or decrease to suit the size and comfort of the adult, as described below in connection with FIGS. 5A and 5B.

The carrier 100 also includes the aforementioned back support 200 described above in connection with FIG. 2. In this example, the back support 200 includes the shoulder straps 102, both of which define an opening 351 through which a head of the adult wearing the carrier 100 is to fit, the center support portion 202, the connectors 109, adjustment straps 356 and strap length adjusters (e.g., shoulder strap length adjustment devices) 358.

To enable the adult to support the weight of the child carrier 100 along with child's weight with relative ease, the connectors 109 are matably coupled to the torso straps 107 described above in connection with FIG. 1 to distribute a load (e.g., a weight load) resulting from carrying the child in the carrier 100. In this example, this weight load is distributed at the shoulder straps 102 as well as the center portion 202, thereby reducing a concentration of applied stresses to the adult wearing the child carrier 100 and providing a comfortable fit to the adult.

To adjust a distance needed to circumnavigate an arm, an upper torso and/or a shoulder of the adult and/or a tension of the shoulder straps 102 acting on the adult, a length of the adjustment straps 356 may be adjusted via the respective strap length adjusters 358.

In some examples, the approximate width 359 of the center portion 202 is approximately 4 inches to approximately 6 inches and, in some examples, approximately 5.25 inches). A peripheral height 360 of the center portion 202, in some examples, is approximately 3.5 inches to approximately 5.5 inches and, in some examples, approximately 4.75 inches. In addition, in this example, a center height 362 of the center portion 202 is approximately 2 inches to approximately 4 inches and, in some examples, approximately 2.75 inches. In this example, an approximate outer distance between the shoulder straps, which is adjustable, can be approximately 20 inches.

In this example, the body support portion 106 has a characteristic width 370 of approximately 12 inches to approximately 16 inches Further, where the body support portion 106 meets the hip belt 110, the body support portion 106 has a width 372 of approximately 13 inches to approximately 15 inches and, in some examples, approximately 14.25 inches. The example dimensions disclosed herein and throughout provide a comfortable fit for the adult and the child. However, the example dimensions disclosed herein are only examples and any appropriate dimensions may be used based on different materials, weight requirements and/or ergonomic factors, etc.

Figure 4:
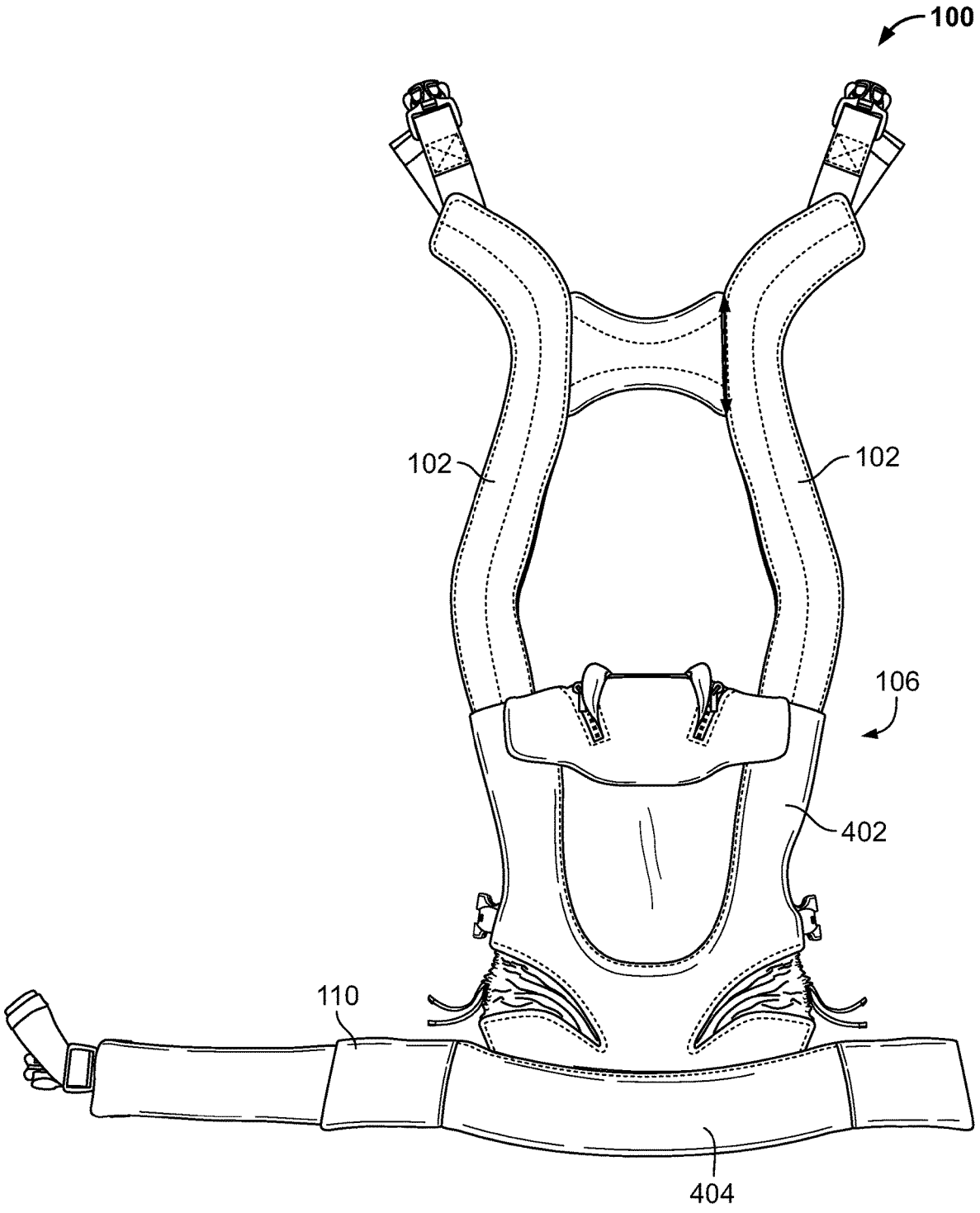
FIG. 4 is a splayed out reverse view of the example child carrier of FIG. 1 shown off of the adult.

FIG. 4 is a splayed out reverse view of the example child carrier 100 of FIG. 1 shown off of the adult. The view shown in FIG. 4 is similar to that of FIG. 3, but on an opposite side from that shown in FIG. 3. As illustrated in the example of FIG. 4, the carrier 100 includes an inner carrier surface 402 of the main body portion 106 and/or the shoulder straps 102 as well as an inner belt surface 404 of the hip belt 110. In some examples, one or more portion(s) of the inner carrier surface 402 and/or the inner belt surface 404 include one or more material(s) different from surfaces and/or fabrics that are viewed from the front of the carrier 100. In particular, such materials may absorb liquids more effectively and/or provide more breathability as compared to the fabrics viewed from the front of the carrier 100, which may carry more aesthetic functionality.

Figure 5A:
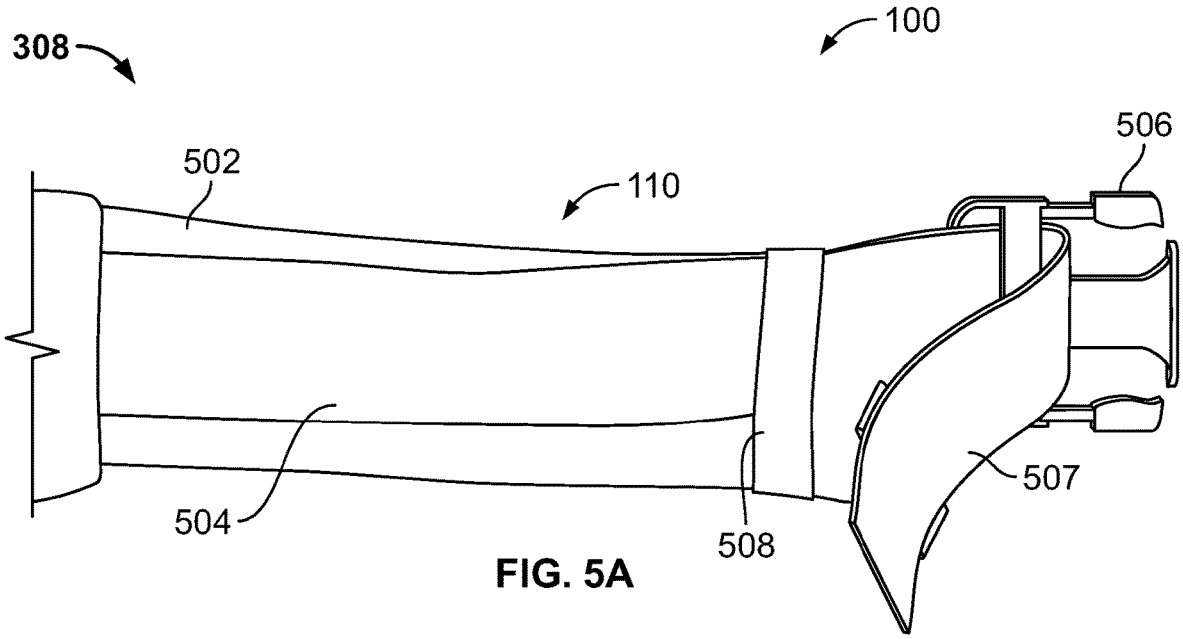
FIG. 5A is a detailed view of a first side of an example waist belt of the example child carrier of FIG. 1 showing a male connector.

FIG. 5A is a detailed view of a first side of the outer hip belt portion 308 of the example hip belt 110 of the example child carrier 100. According to the illustrated view of FIG. 5A, the first side includes a belt portion 502, a hip strap 504, a male connector 506, a length adjuster 507 and a hip strap guide 508. In this example, the hip strap 504 is guided by the hip strap guide 508 and a length of the hip strap 504 is adjustable via the length adjuster 507. In particular, this length is adjustable to accommodate various adult sizes and/or to adjust an amount of support or load near a hip and/or waist of the adult.

Figure 5B:
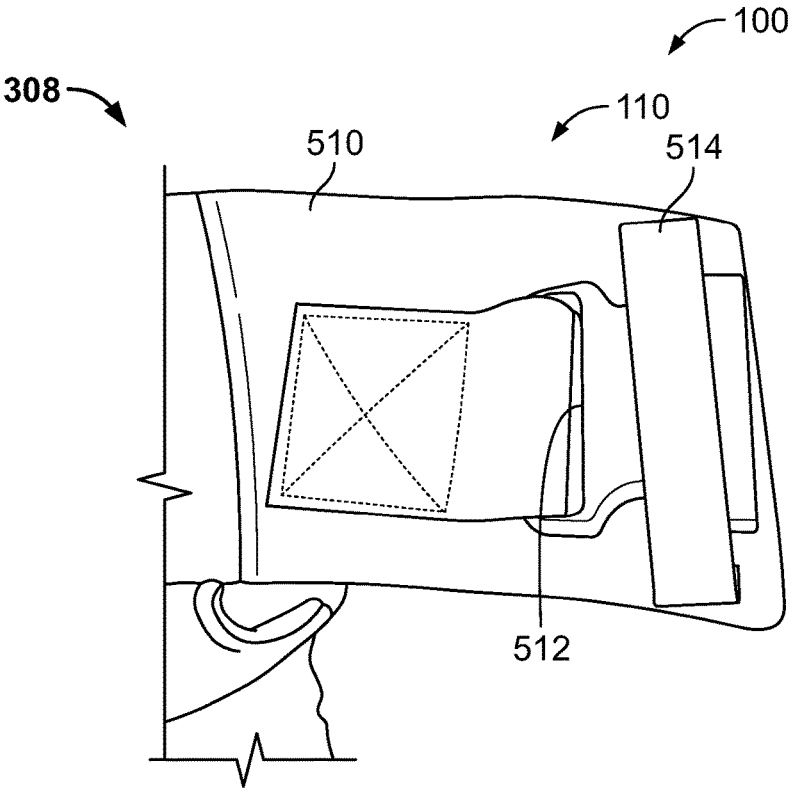
FIG. 5B is a detailed view of a second side of the example waist belt of the example child carrier of FIG. 1 showing a female connector.

FIG. 5B is a detailed view of a second side of the outer hip belt portion 308 of the example hip belt 110 of the example child carrier 100. In this example, the second side includes a belt portion 510, a female connector (e.g., a buckle) 512 and a connector guide 514. The female connector 512 of the illustrated example is matably couplable to the male connector 506 shown in FIG. 5A and guided by the connector guide 514.

Figure 6A:
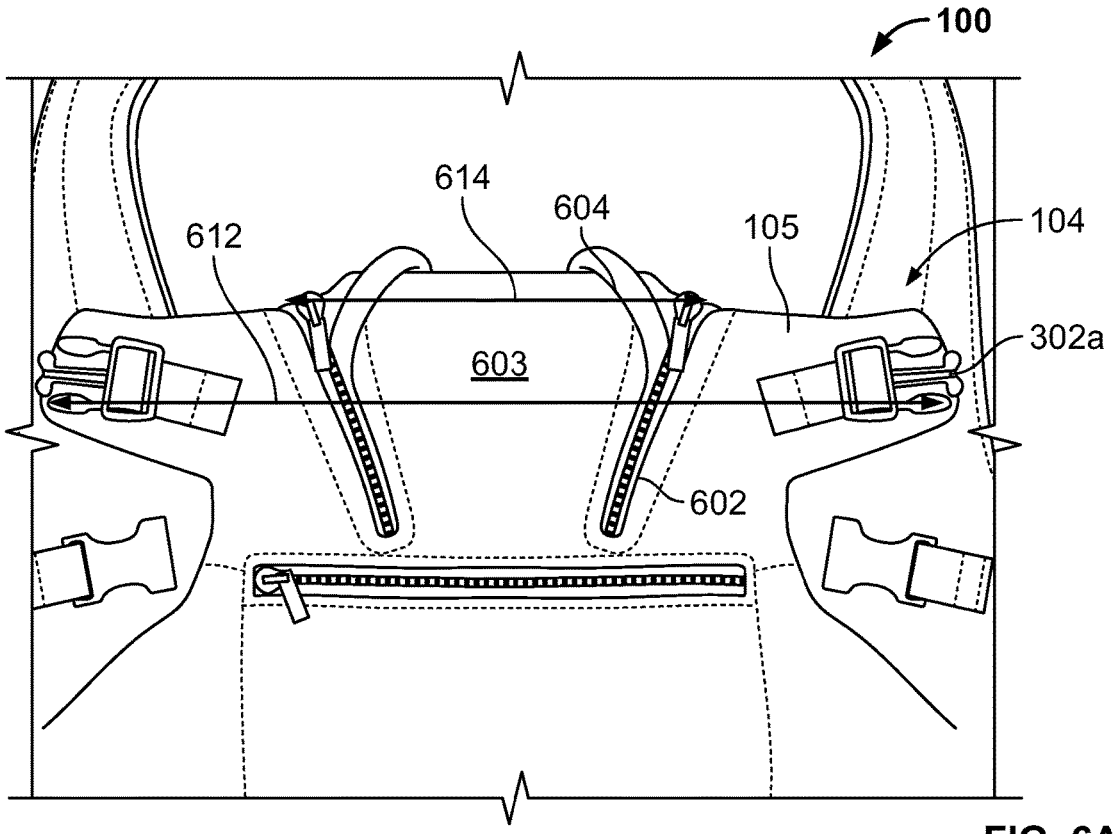
FIGS. 6A and 6B are detailed views of an expandable example head rest of the example child carrier of FIG. 1, shown in a retracted position and an expanded position, respectively.
Figure 6B:
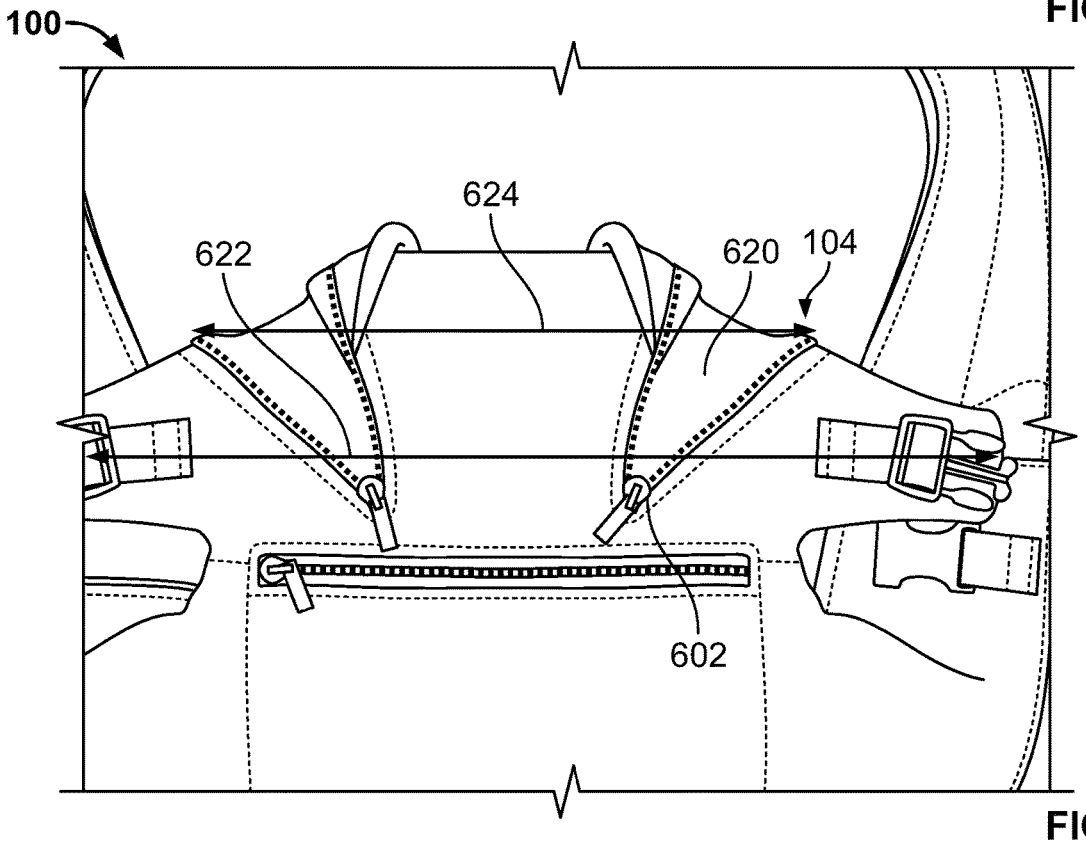

FIGS. 6A and 6B are detailed views of the example head rest 104 of the example child carrier 100 of FIG. 1, shown in an unexpanded state and an expanded state, respectively. The example head rest 104 includes an example head rest extension fastener 602, which is implemented as a zipper 602 in this example, disposed on both sides of a middle head rest portion 603. In this example, the each of the fasteners 602 are independently operable of one another. The example also includes a fastener cover 604 for each of the fasteners 602. The fastener cover 604 of the illustrated example is composed of a soft cloth or fabric and is movable (e.g., foldable) onto or over at least a portion of the respective fastener 602 to cover at least a portion of the fastener 602 (see FIG. 1), thereby preventing the child from contacting the fastener 602.

In this example, when the fastener 602 is secured or closed (e.g., zipped), the head rest 104 is maintained in the unexpanded state. In particular, closing the fastener 602 prevents the head rest 104 from being expanded horizontally. In some examples, a width 612 of the head rest 104 including the head rest flaps 105 is approximately 11.75 inches. Also, in some examples, a width 614 between upper ends of the fasteners 602 is approximately 5.25 inches. Further, in some examples, the fastener is approximately 3.25 inches in length and the pocket fastener 305 is approximately 7 inches. The dimensions shown are only examples and any appropriate dimensions may be used.

In FIG. 6B, the example head rest 104 is shown in the expanded state. In the expanded state, the fastener 602 has been opened or unfastened to expose an expansion flap 620 and, thus, increasing an overall width of the example head rest 104. In the expanded state, overall widths 622, 624 are increased (compared to the widths 612, 164 in the unexpanded state) to allow increased clearance and/or increased elasticity when the head support 104 contacts and/or wraps around at least a portion of the head of the child. In this example, the expansion flap 620 has a substantially triangular shape, which allows the head rest 104 to expand more effectively in a horizontal direction. In this example, the head rest 104 is foldable downward in either the expanded state or the unexpanded state (e.g., respective stowed and deployed positions).

In this example, the expansion flap 620 is composed of a different material (e.g., a thinner material) from that of other portions of the head rest 104. Additionally or alternatively, the expansion flap 620 is composed of fabric or other expandable member that includes an elastic material.

In some examples, the width 622 of the expanded head rest 104 including the head rest extensions 105 is approximately 13.25 inches. In addition, in some examples, the width 624 between the outer edges of the upper portions of the fasteners 602 is approximately 6.25 inches in the expanded states. The example adjustable width ranges are only examples and, therefore, any appropriate application or design appropriate dimension and/or dimensional ranges may be used based on application or design needs.

Figure 7A:
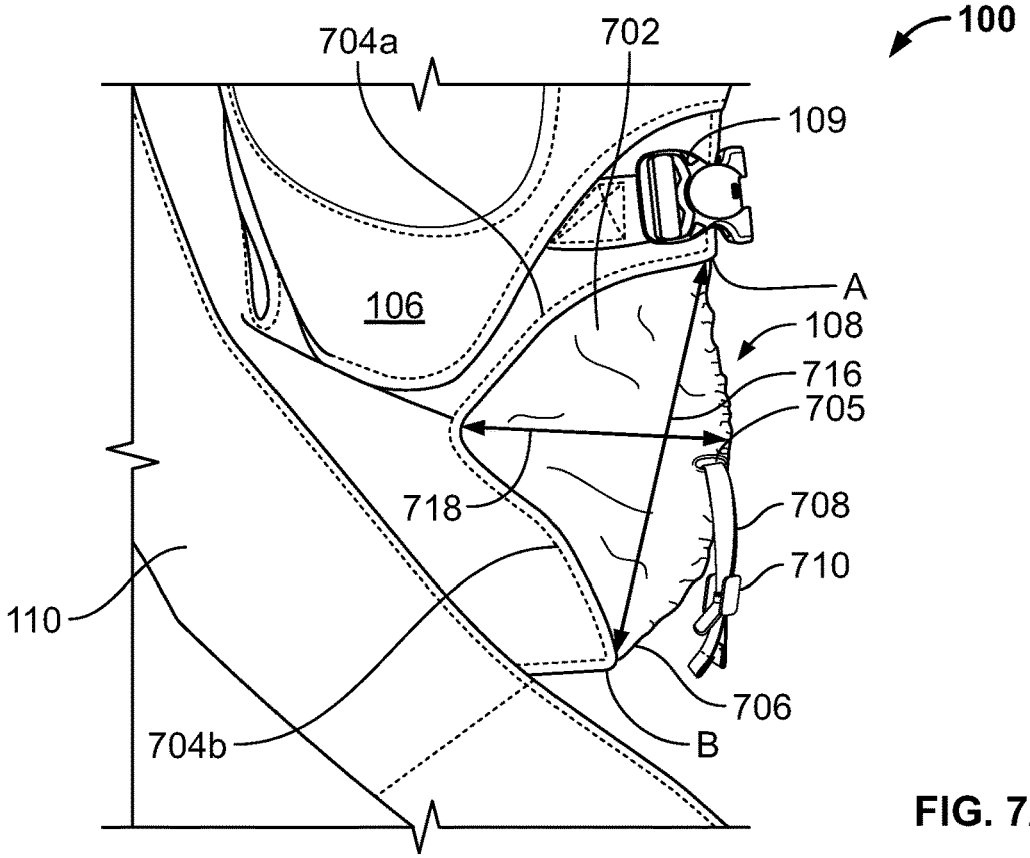
FIGS. 7A and 7B are detailed views of an example expandable leg support of the example child carrier of FIG. 1, shown in a deployed position and a stowed position, respectively.
Figure 7B:
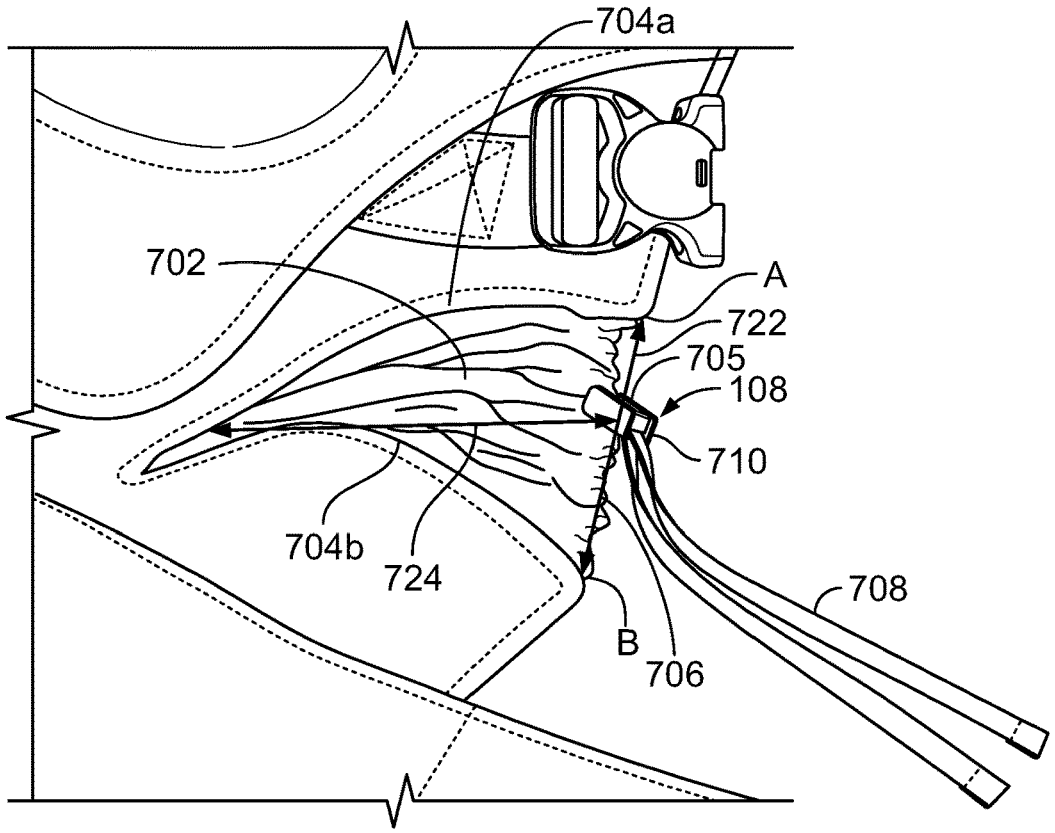

FIGS. 7A and 7B are detailed views of the expandable example leg support 108 of the example child carrier 100, shown in deployed and un-deployed positions, respectively. According to the illustrated example, the leg support 108 is disposed on the body support portion 106 between the hip belt 110 and the torso strap connector 109. The leg support 108 of the illustrated example includes a leg support body 702 that is made of a cloth, a web material, and/or other suitable material(s) including, for example, one or more elastic or partially elastic material(s). In some examples, the leg support 108 and, in particular, the leg support body 702 is composed of a different material from that of the body support portion 106 (e.g., similar to the expansion flaps 620 of the head rest 104 disclosed above). Additionally or alternatively, the leg support body 702 is has a smaller thickness relative to the body support portion 106.

The leg support body 702 is coupled to the body support portion 106 via any suitable mechanical or chemical fastener. In the illustrated example, the leg support body 702 is stitched to the body support portion 106. The leg support body 702 has a first a first edge 704*a*, a second edge 704*b*, and an opening 705 that is defined on a channel 706, which extends along a peripheral outer edge of the leg support 108 (e.g., at an edge at least partially defining an outer edge of the body support portion 106) between points A and B in FIG. 7A. In this example, the channel 706 is encloses a draw string 708 to which a clasp or other suitable lock 710 is coupled. The features of the draw strong 708 are discussed in greater detail below. Also, in this example, the leg support body 702 has a generally triangular shape but in other examples, the leg support body 702 may have other suitable shapes including, for example, a wedge, a circular sector or pie-shape, a Reuleaux triangle shape, a polygon, or any other suitable shape.

To vary a degree of engagement between the leg support 108 and the leg and/or the upper leg of the child, a portion of the draw string 708 of the illustrated example may be drawn into or moved from the channel 706. In particular, varying a length of the draw string 708 extending out of the channel 706 via the opening 705 varies a degree to which the leg support body 702 is stretched or expanded and/or folded by altering an effective surface area or foot print of the leg support body 702, thereby varying an effective distance between the first and second edges 704*a* and 704*b* as well as points A and B. In this example, multiple ends (e.g., two) of the draw string 708 extend out of the channel 706 via the opening 705. In other examples, only a single end of the draw string 708 extends from the channel 706. In some examples, multiple draw strings 708 extend from opposing ends of the channel 706 and out from the opening 705.

In this example, as the leg support 108 is extended from a stowed position (shown in FIG. 7B) to one of a plurality of deployed positons, support to the respective leg and/or upper leg of the child is increased. In other words, a first distance between a side of the lower pouch area 116 and a side of the medial pouch area 114 in the stowed position is different from a second distance therebetween in one of the plurality of deployed positions.

While the example draw string 708 is shown extending out of a generally central portion of the channel 706, the example draw string 708 may extend out of other portions of the channel 706 and/or the leg support body 702 (e.g., at an end of the channel 706). Also in some examples, the channel 706 is not disposed on a peripheral outer edge. For example, the channel 706 max extend across a central portion of the leg support body 702.

In some examples, an approximate height 716 of the leg support is 10 inches. Also, in some examples, an approximate width 718 of the leg support 108 is 6.25 inches. These dimensions, however, are only examples and any appropriate dimensions may be used.

While the draw string 708 is implemented to adjust an operational surface area of the main body 702 and/or the leg support 108 in the examples shown, any appropriate length adjustment device or mechanism may be used such as, but not limited to, a collapsing rod (e.g., with multiple cylindrical elements), an actuator (e.g., an electric actuator), a sliding device and/or a solenoid.

The example leg support 108 is illustrated in FIG. 7B in an un-deployed, retracted, or stored position, in which the leg support body 702 has a decreased operational surface area. In contrast to the example position shown in FIG. 7A, the draw string 708 of the illustrated example has been pulled and/or drawn away from the opening 705 of the channel 706, thereby effectively contracting and/or folding (e.g., ruffling) the leg support body 702 and, thus, shortening a distance between the first and second edges 704*a* and 704*b*. In other words, the effective footprint and/or the effective surface area (e.g., the operative surface area) of the leg support 108 and the leg support body 702 has been reduced to bring the points A and B closer to one another. In this example, the clasp 710 restrains movement of the draw string 708 relative to the opening and/or the channel 706 to maintain the leg support 108 in the un-deployed position by maintaining a length of the draw string 708 extending out of the opening 705. In some examples, the clasp 710 is spring-loaded to bias the clasp to a closed position in which the clasp 710 securely clamps the draw string 708. In addition, in this example, the clasp 710 corresponding to a right side of the carrier 100 is independently operable of the clasp 710 corresponding to the left side of the carrier 100.

To move the leg support 108 to the deployed position, the user activates the clasp 710 by, for example, applying a force against the bias of the spring, to at least partially disengage the clasp 710 from the draw string 708 and enable the draw string 708 to retreat into the opening 705 and the channel 706, which allows the first and second edges 704*a* and 704*b* to move away from each other, thus expanding the leg support 108.

The draw string 708 of the illustrated example can be adjusted to vary the deployment of each of the leg supports 108 to a substantial degree. In particular, the clasp 710 can restrain the draw string 708 in a plurality of non-discrete intermediary positions so that the leg support 108 is fully contracted, fully deployed, or disposed in one or a plurality of intermediary positions therebetween. These adjustment ranges can be used to accommodate children of different sizes and/or weights to enhance comfort and provide a secure fit. For example, FIG. 7A shows the distance 716 between points A and B for the fully deployed position, which may be suitable for a child of a particular size and/or age. For a younger and/or smaller child, it may be desirable to decrease the distance 716 between points A and B from that shown in FIG. 7A, while maintaining some level of deployment of the leg supports 108 (and, thus, creating a distance between points A and B that is greater than the distance 722 shown in FIG. 7B). The ability to deploy the leg support 108 to a plurality of non-discrete positions allows the adult to securely and comfortably hold children of many sizes. This also allows the adult to adjust the carrier 100 as the child grows without needing to purchase a new carrier to accommodate a bigger child.

In some examples, in the contracted position of FIG. 7B, the approximate height 722 of the leg support height is 2.75 inches. In addition, the approximate width 724 of the leg support 108 is 5.5 inches. The dimensions disclosed herein that are associated with the leg support 108 are only examples any appropriate dimension(s) may be used based on design needs and/or application(s).

Figure 8A:
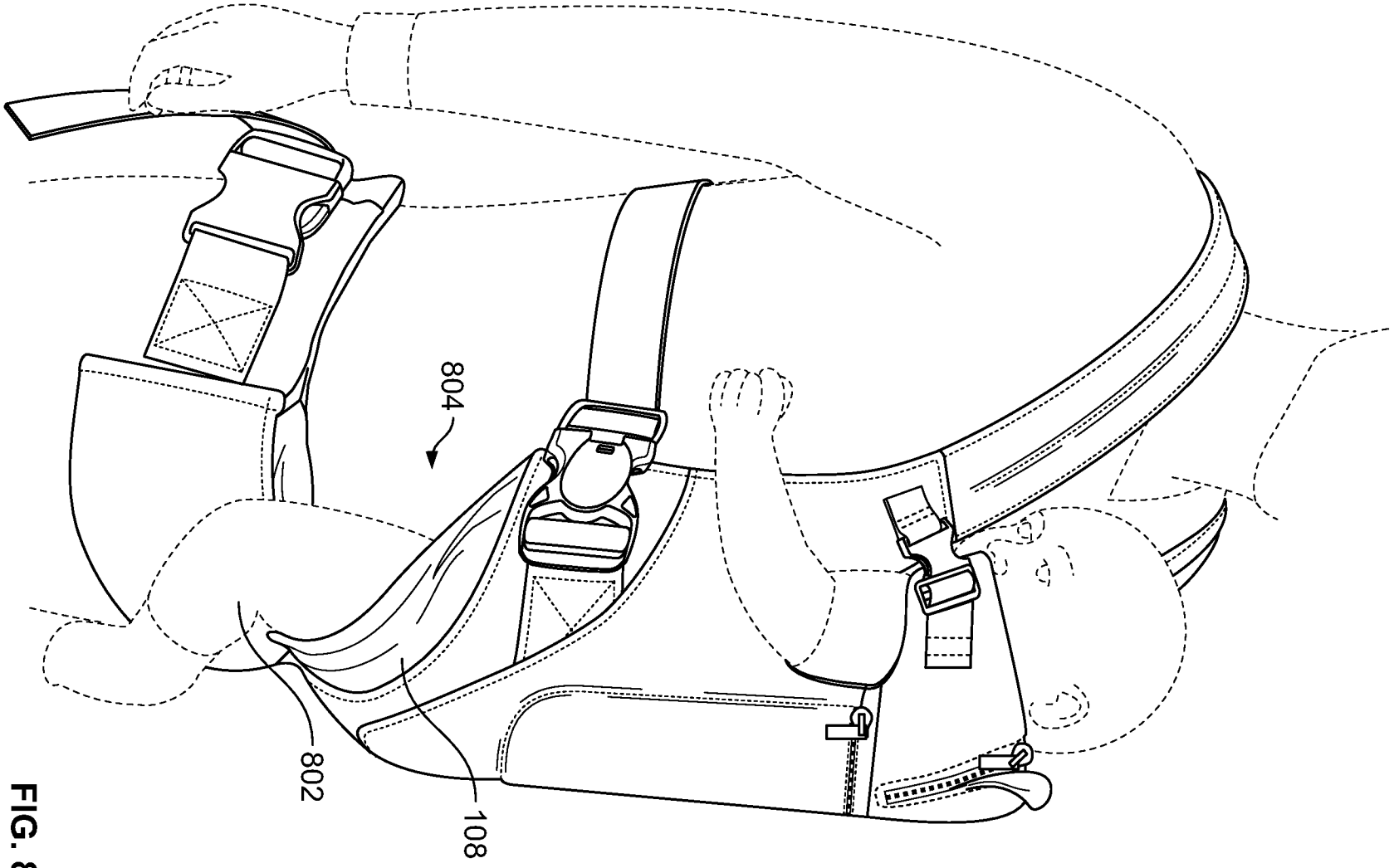
FIGS. 8A and 8B are detailed views illustrating use of the example leg support in the stowed position.
Figure 8B:
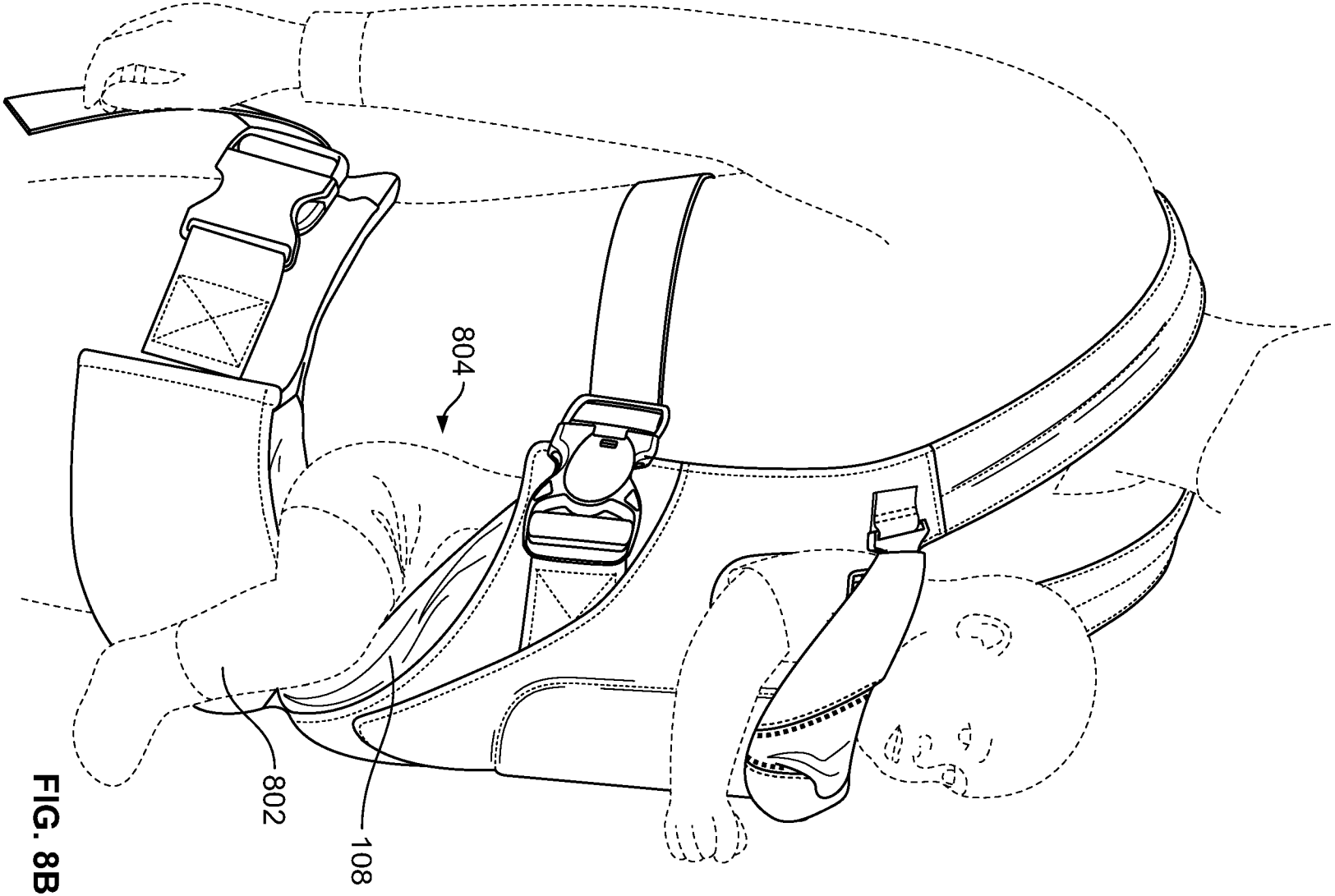

FIGS. 8A and 8B are detailed views of the example leg support in the un-deployed position. FIG. 8A depicts a child 804 in a reverse-facing position (e.g., the child 804 facing towards the adult) while FIG. 8B depicts child 804 in a forward-facing position (e.g., the child 804 facing away from the adult). As illustrated in FIGS. 8A and 8B, a leg 802 of the child 804 is allowed to hang freely when the leg support 108 is in the retracted or un-deployed position regardless of which direction the child faces.

Figure 8C:
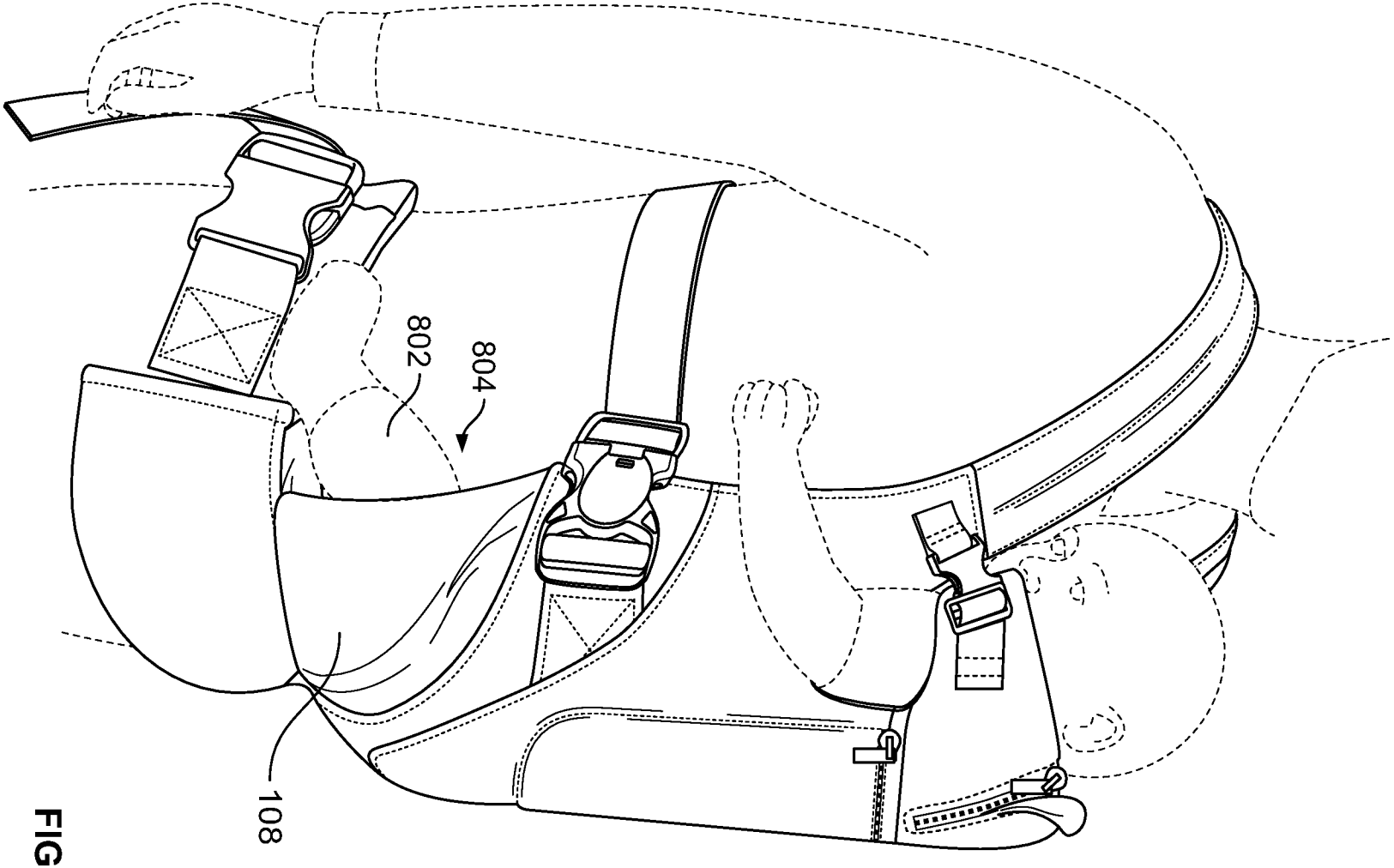
FIG. 8C is a detailed view illustrating use of the example leg support in the deployed position.

FIG. 8C is a detailed view of the example leg support 108 in the deployed leg support position. As illustrated in the example of FIG. 8C, an upper leg and/or thigh of the child 804 is supported by the upper leg support 108 while the child 804 is facing towards the adult. In this example, the upper leg portion and/or thigh of the leg 802 is angled at a relatively horizontal position (in the view of FIG. 8C). An age and/or size of the child held in the carrier 100 may be used to determine whether the child is to be held in carrier 100 with the leg support 108 in the deployed position. For example, a toddler may have his or her legs dangling from the carrier 100 as shown in FIGS. 8A and 8B, while a newborn may be swaddled in a position (e.g., a "froggy" position, a fetal position, a feeding position, etc.) such as where his or her legs are folded against the adult while facing the adult instead of dangling from the carrier 100, as shown in FIG. 8C.

An example child carrier disclosed herein includes a child support pouch to receive a child in a substantially upright position, where the child support pouch includes an upper pouch area, a medial pouch area and a lower pouch area. The example child carrier also includes a harness to support the child support pouch on an adult, where the harness includes a first upper strap coupled to the upper pouch area, a second upper strap coupled to the upper pouch area, and a lower strap coupled to the medial pouch area. The example child carrier also includes a first leg support coupled to the child support pouch at the lower pouch area, where the first leg support pouch has a first continuously adjustable operative surface area, and a second leg support coupled to the child support pouch at the lower pouch area, where the second leg support pouch having a second continuously adjustable surface area.

In some examples, the child carrier further includes including a first lock coupled to the first leg support to prevent adjustability of the first continuously adjustable operative surface area. In some examples, the child carrier further includes a second lock coupled to the second leg support to prevent adjustability of the second continuously adjustable operative surface area. In some examples, the first lock and the second lock are independently operable. In some examples, the first leg support is movable between a first stowed position and a first deployed position and the second leg support is moveable between a second stowed position and a second deployed position.

In some examples, the first continuously adjustable operative surface area is less in the first stowed position than in the first deployed position, and the second continuously adjustable operative surface area is less in the second stowed position than the second deployed position. In some examples, the first leg support and the second leg support provide increasing support to legs of a child occupant as the first leg support moves from the first stowed position to the first deployed position and the second leg support moves from the second stowed position to the second deployed position. In some examples, a first side of the lower pouch area and a first side of the medial pouch are a separated a first distance when the first leg support is in the first stowed position and are separated a second distance when the first leg support is in the first deployed position, the second distance different from the first distance. In some examples, the second distance is greater than the first distance.

In some examples, when the first leg support and the second leg support are in the respective first stowed position and second stowed position, a child occupant is positionable either facing an adult wearing the carrier or facing away from the adult. In some examples, a child occupant is positionable facing toward an adult wearing the carrier when the first leg support and the second leg support are positioned in the first deployed position and the second deployed position, respectively. In some examples, the child carrier includes a head rest coupled to the upper pouch area, the head rest including a first head rest flap, a middle head rest portion, a second head rest flap, a first head rest extension disposed between the middle head rest portion and the first head rest flap, and a second head rest extension disposed between the middle head rest portion and the second head rest flap.

In some examples, the first head rest extension is moveable between a first stowed position and a first deployed position and the second head rest extension is moveable between a second stowed position and a second deployed position. In some examples, the middle head rest portion is positioned from the first upper strap a first distance when the first head rest extension is in the first stowed position and a second distance when the first head rest extension is in the first deployed position, the second distance different than the first distance. In some examples, the middle head rest portion is positioned from the first upper strap a third distance when the first head rest extension and the second head rest extension are in the first deployed position and second deployed position, respectively, the third distance different than the second distance.

In some examples, the child carrier further includes a first head rest extension fastener to hold the first head rest extension in the first stowed position and a second head rest extension fastener to hold the second head rest extension in the second stowed position. In some examples, the first head rest extension fastener and the second head rest extension fastener are independently operable. In some examples, the head rest is foldable over the upper pouch area when the first head rest extension and the second head rest extension are in either the respective first and second stowed positions or the respective first and second deployed positions.

In some examples, the child carrier further includes a first upper strap fastener, a first head rest flap fastener releasably couplable to the first upper strap fastener, a second upper strap fastener, and a second head rest flap fastener releasably couplable to the second upper strap fastener. In some examples, the middle head rest portion is positioned from the first upper strap a third distance when the first head rest extension and the second head rest extension are in the first deployed position and second deployed position, respectively, the third distance different than the second distance.

In some examples, the child carrier further includes a first head rest extension fastener to hold the first head rest extension in the first stowed position and a second head rest extension fastener to hold the second head rest extension in the second stowed position.

In some examples, the first head rest extension fastener and the second head rest extension fastener are independently operable. In some examples, the head rest is foldable over the upper pouch area when the first head rest extension and the second head rest extension are in either the respective first and second stowed positions or the respective first and second deployed positions. In some examples, the child carrier further includes a first upper strap fastener, a first head rest flap fastener releasably couplable to the first upper strap fastener, a second upper strap fastener, and a second head rest flap fastener releasably couplable to the second upper strap fastener.

In some examples, the head rest is movable between an upright position and a folded over position when the first head rest extension and the second head rest extension are in either the respective first and second stowed positions or the respective first and second deployed positions, the first upper strap fastener and the first head rest flap fastener are couplable in either the upright position or the folded over position, and the second upper strap fastener and the second head rest flap fastener are couplable in either the upright position or the folded over position.

An example child carrier includes a head rest coupled to an upper pouch area of the child carrier. The head rest includes a first head rest flap, a middle head rest portion, a second head rest flap, a first head rest extension disposed between the middle head rest portion and the first head rest flap, and a second head rest extension disposed between the middle head rest portion and the second head rest flap, the first and second head rest extensions to be moveable be moveable between respective stowed positions and deployed positions to vary a width of the head rest.

In some examples, the first head rest extension and the second head rest extension include a fabric. In some examples, the child carrier further includes at least a first zipper corresponding to the first head rest extension and a second zipper corresponding to the second head rest extension to expand or contract the respective first head rest extension or the second head rest extension.

From the foregoing, it will be appreciated that the above disclosed methods, apparatus and articles of manufacture enable a very effective manner of supporting a child's upper leg and/or thigh with ease for both the child and an adult or parent carrying the child. The examples disclosed herein also enable a highly adjustable head rest and/or head support for a child being carried in a baby carrier. Further, the examples disclosed herein enable a reliable and cost-effective manner of implementing adaptable leg supports for a child.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent. While the examples disclosed herein are shown related to child carriers, the examples disclosed herein may be implemented in any other appropriate application such as pet carriers, etc. Any of the dimensions and dimension ranges described herein are examples and may be varied based on design needs and applications.

What is claimed is:

1. A child carrier comprising:

a child support pouch to receive a child in a substantially upright position;

a harness to support the child support pouch on an adult;

a first leg support coupled to the child support pouch at a lower portion of the child support pouch, the first leg support having a first adjustable surface area;

a second leg support coupled to the child support pouch at the lower portion of the child support pouch, the second leg support having a second adjustable surface area;

a first lock coupled to the first leg support to prevent adjustability of the first adjustable surface area; and a second lock coupled to the second leg support to prevent adjustability of the second adjustable surface area.

2. The child carrier as defined in claim 1, wherein the first lock and the second lock are independently operable.

3. The child carrier as defined in claim 1, wherein the first leg support is movable between a first stowed position and a first deployed position and the second leg support is moveable between a second stowed position and a second deployed position.

4. The child carrier as defined in claim 1, further including a length adjustable device extending along a peripheral outer edge of the first leg support, the first adjustable surface area being adjustable via the length adjustable device.

5. The child carrier as defined in claim 4, wherein the length adjustable device is a first length adjustable device, and further including a second length adjustable device extending along a peripheral outer edge of the second leg support, the second adjustable surface area being adjustable via the second length adjustable device.

6. The child carrier as defined in claim 1, wherein the first leg support includes a triangular shape.

7. The child carrier of claim 1, further including a fastener, the first leg support being coupled to the child support pouch via a fastener.

8. The child carrier of claim 7, wherein the fastener is a first fastener, the first leg support coupled to the child support pouch via the first fastener on a first side of the child support pouch, the child carrier further including a second fastener, the second leg support coupled to the child support pouch via the second fastener on a second side of the child support pouch.

9. The child carrier of claim 1, wherein the first leg support includes a first panel of a first material, and the child support pouch includes a second panel of a second material, the second material different than the first material.

10. The child carrier of claim 9, wherein the first panel has a first thickness, and the second panel has a second thickness, the second thickness different than the first thickness.

11. The child carrier as defined in claim 1, wherein the first lock adjusts a tension of the first leg support, and wherein the second lock adjusts a tension of the second leg support.

12. The child carrier as defined in claim 1, wherein the first leg support includes a captive draw string to vary the first adjustable surface area.

13. The child carrier as defined in claim 12, wherein the captive draw string varies a length of a peripheral edge of the first leg support.

14. The child carrier as defined in claim 1, wherein the first leg support includes a collapsible rod to vary the first adjustable surface area.

15. A child carrier comprising:

a child support pouch to receive a child in a substantially upright position;

a harness to support the child support pouch on an adult;

a first leg support coupled to the child support pouch at a lower portion of the child support pouch, the first leg support having a first adjustable surface area;

a second leg support coupled to the child support pouch at the lower portion of the child support pouch, the second leg support having a second adjustable surface area;

a first lock coupled to the first leg support to prevent adjustability of the first adjustable surface area;

a first length adjustable device extending along a peripheral outer edge of the first leg support, the first adjustable surface area being adjustable via the length adjustable device;

a second lock coupled to the second leg support to prevent adjustability of the second adjustable surface area; and a second length adjustable device extending along a peripheral outer edge of the second leg support, the second adjustable surface area being adjustable via the second length adjustable device.

16. A child carrier comprising:

a child support pouch to receive a child in a substantially upright position;

a harness to support the child support pouch on an adult;

a first leg support coupled to the child support pouch at a lower portion of the child support pouch, the first leg support having a first adjustable surface area;

a second leg support coupled to the child support pouch at the lower portion of the child support pouch, the second leg support having a second adjustable surface area;

a lock coupled to the first leg support to prevent adjustability of the first adjustable surface area; and a length adjustable device extending along a peripheral outer edge of the first leg support, the first adjustable surface area being adjustable via the length adjustable device, wherein the lock is to prevent movement of the length adjustable device.

17. A child carrier comprising:

a child support pouch to receive a child in a substantially upright position;

a harness to support the child support pouch on an adult;

a first leg support coupled to the child support pouch at a lower portion of the child support pouch, the first leg support having a first adjustable surface area;

a second leg support coupled to the child support pouch at the lower portion of the child support pouch, the second leg support having a second adjustable surface area; and a lock coupled to the first leg support to prevent adjustability of the first adjustable surface area, wherein the first leg support includes a triangular shape, and wherein the first leg support is coupled to the child support pouch on a first side and a second side of the triangular shape.

18. The child carrier of claim 17, wherein a third side of the first leg support is an unattached edge of the triangular shape that is coupled to the child support pouch via the first side and the second side of the triangular shape, the child carrier further including a length adjustable device extending along the unattached edge of the first leg support.

* * * * *